United States Patent [19]

Leer

[11] Patent Number: 4,771,741

[45] Date of Patent: Sep. 20, 1988

[54] NON-ROTATIVE ROLLER TAPPET ARRANGEMENT FOR INTERNAL COMBUSTION ENGINES

[75] Inventor: Marc Leer, Neuss, Fed. Rep. of Germany

[73] Assignee: Ford Motor Company, Dearborn, Mich.

[21] Appl. No.: 34,362

[22] Filed: Apr. 6, 1987

[30] Foreign Application Priority Data

Jul. 2, 1986 [DE] Fed. Rep. of Germany ..... 3622245

[51] Int. Cl.[4] ..... F01L 1/14

[52] U.S. Cl. ..... 123/90.5

[58] Field of Search ..... 123/90.5, 90.55, 90.48

[56] References Cited

U.S. PATENT DOCUMENTS

| | | | |
|---|---|---|---|
| 1,254,227 | 1/1918 | Huber | 123/90.5 |
| 2,175,466 | 10/1939 | Johnson | 123/90.5 |
| 3,314,303 | 4/1967 | Maat | 123/90.5 |
| 3,822,683 | 7/1974 | Clouse | 123/90.5 |
| 3,886,808 | 6/1975 | Weber | 123/90.5 |
| 3,998,190 | 12/1976 | Keske | 123/90.5 |

FOREIGN PATENT DOCUMENTS

| | | | |
|---|---|---|---|
| 2758862 | 7/1979 | Fed. Rep. of Germany | 123/90.5 |
| 358911 | 9/1922 | Fed. Rep. of Germany | 123/90.5 |

*Primary Examiner*—Willis R. Wolfe

*Attorney, Agent, or Firm*—Robert E. McCollum; Clifford L. Sadler

[57] ABSTRACT

A roller type tappet body has a tappet, a lock pin type guide member, and axial guide grooves which cooperate with one another to secure the body against rotation, an axial guide groove in the cylindrical tappet bore that guides the tappet body into the cylinder block or head being formed from the remaining part of a small longitudinally extending bore that is initially bored and subsequently opened by the boring of the larger cylindrical tappet bore to form a semicircular cross-section, the guide member being secured to the tappet body and formed with a round or partly round cross-section from a cover plate for a portion of the tappet assembly.

4 Claims, 3 Drawing Sheets

NON-ROTATIVE ROLLER TAPPET ARRANGEMENT FOR INTERNAL COMBUSTION ENGINES

The invention relates to a roller tappet arrangement with rotation prevention means, and more particularly, to one for use in automotive type internal combustion engines.

A simple tappet arrangement, with rotation prevention means, in particular for internal combustion engines, is disclosed in German Patent No. 27 58 862. In one embodiment, rotation is prevented by means of an axial guide groove 9 formed in the tappet body cooperating with a guide member 8 disposed in the cylinder head and projecting into the guide groove. In an alternative embodiment, lateral guide surfaces on the tappet body 6 cooperate with guide plates 11 secured to the cylinder block or to the cylinder head. This arrangement has the disadvantage that the production of the axial guide groove in the tappet body and the arrangement of the guide member in the cylinder block or cylinder head, or, alternatively, the production of the guide surfaces on the tappet body and the mounting of the guide plates on the cylinder block or on the cylinder head, require either complicated machining steps or complicated assembly procedures.

A roller tappet arrangement with prevention of rotation for use in particular in internal combustion engines is also known from the German Patent No. 30 39 946. In this case, the rotation-preventing means again is formed by a guide plate 60 which is secured to one tappet body between two other tappet bodies, and which cooperates with lateral guide surfaces 50, 51 on the other tappet bodies in order to prevent a rotational movement of the roller tappets about their longitudinal axes. The nature of the mounting of the guide plate upon the tappet body, however, is unclear as it is stated merely that it is to be effected in a rigid manner and a welded connection is shown in FIG. 2.

In the above case, the manufacture and assembly of a roller tappet arrangement of this type with rotation prevention means is rendered relatively simple, since no machining need be performed on a cylinder block or on the cylinder head, and no special sequence of assembly need be observed. However, on the other hand, the roller tappets must lie close to one another or the guide plate secured to the tappet body will be too large and its mass will adversely affect the functioning of the tappet. Also, a welded connection must be effected on the ready-machined tappet body, and this has the disadvantage that the latter can become distorted in an undesired manner.

It is a primary object of the invention, therefore, to provide an improved roller tappet arrangement with rotation prevention means, in particular for internal combustion engines, by providing in a simple manner an axial guide groove in the tappet body and also either in the cylinder block or head for cooperation with a guide member that can be secured in a simple manner to the tappet body, and has a low mass.

The invention accomplishes the above by providing, inter alia, an axial guide groove in the periphery of the wall defining the cylindrical tappet bore in which the tappet body is guided in the cylinder block or in the cylinder head, the groove being defined or formed as the semi-circular part that remains after an initial small longitudinally extending bore is made and subsequently opened or cut in half when a larger overlapping cylindrical tappet bore is made. A lock pin type guide member, with a round or partly round cross-section, which cooperates with the axial guide groove and a mating facing axial groove in the tappet body, then is assembled and secured to the tappet body. Rotation is prevented in a reliable manner with little structural outlay.

The tappet body in this case includes a known type of hydraulic lash adjusting device having a cover that is secured to the tappet body. The cover is in the form of a plate that integrally serves as a guide member for insertion of the tappet body with the block or head bore. According to the invention, a round or partly round cross-section of the cover plate-guide member can be formed by bending a portion of it round in a C-shaped manner to constitute a locking pin of the anti-rotation assembly. The locking pin/guide member is thus integral with the plate so that the assembly of the closure member/plate to the tappet body also simultaneously secures the guide member to the tappet.

Other objects, features and advantages of the invention will become more apparent upon reference to the succeeding detailed description thereof, and to the drawings illustrating the preferred embodiment thereof; wherein, FIG. 1 is a side elevational view, with parts broken away and in section, of a roller tappet arrangement, with rotation prevention means, constructed according to the invention;

Figure 1:
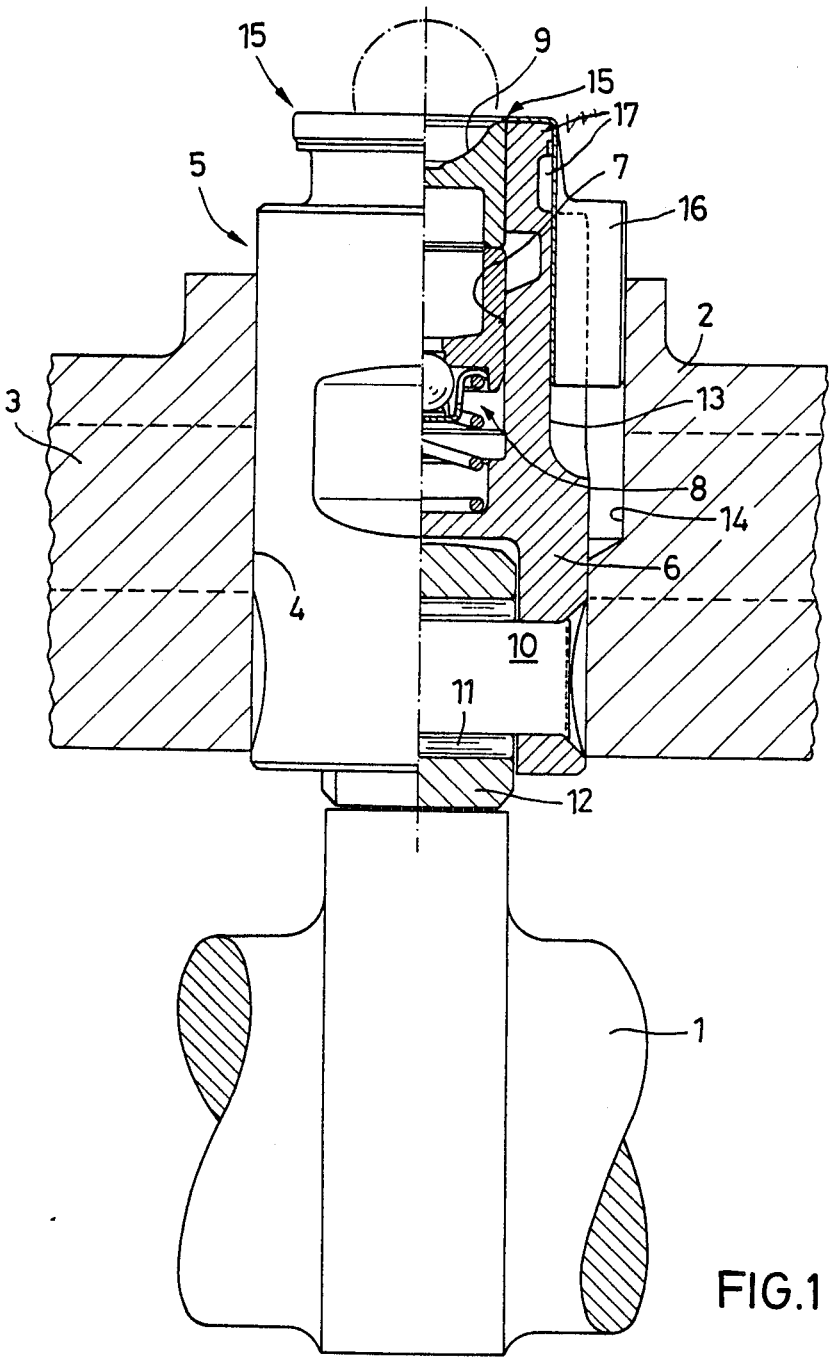

FIG. 1 shows a portion of an internal combustion engine that includes a camshaft 1 having a cam engaging the lower end of a valve tappet 5. The tappet has a cylindrical tappet body 6 that is mounted in a cylindrical tappet guide bore 4 provided in a part 2 of a cylinder block or cylinder head 3.

The valve tappet 5 can be either a conventional normal mechanical type roller valve tappet or, preferably, a roller valve tappet with hydraulic lash adjusting means.

The embodiment illustrated in the figures relates to a roller tappet 5 having a cylindrical tappet body 6. A cylindrical bore 7 receives therein a hydraulic lash adjusting device 8 that includes a tappet rod cup 9. The lower cylindrical end of tappet body 6 is formed with a yoke or fork shape for receiving therein a roller 12 rotatably mounted on a shaft 10 by way of needle bearings 11, for cooperation with the cams on camshaft 1.

Figure 2:
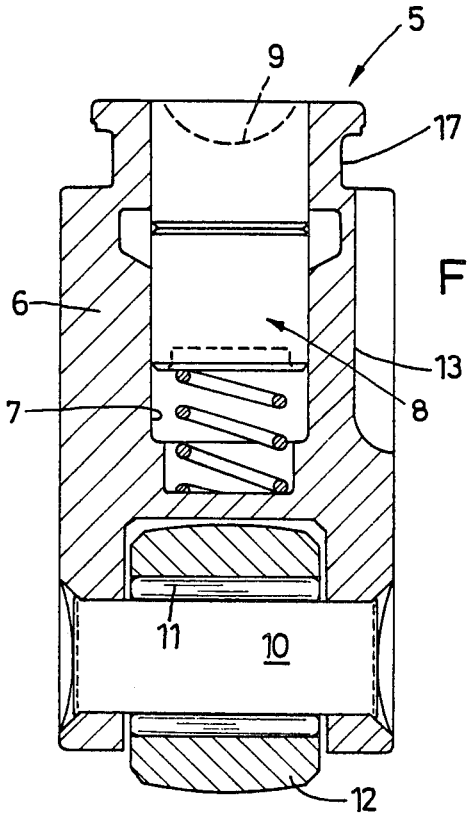
FIG. 2 is a cross-sectional view of a portion of the roller tappet of FIG. 1.
Figure 3:
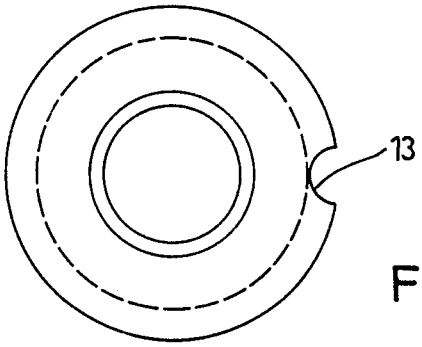
FIG. 3 is a plan view of the roller tappet in FIG. 2.
Figure 4:
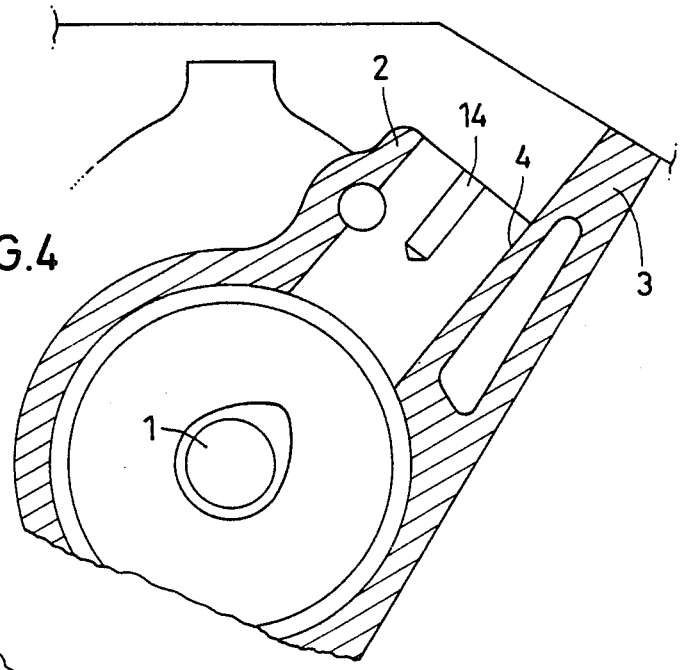
FIG. 4 is a vertical section along the axis of a tappet bore in the cylinder block.
Figure 5:
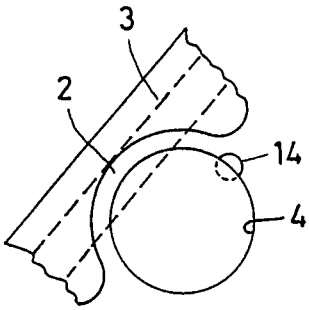
FIG. 5 is an enlarged partial plan view of the tappet bore in FIG. 4.

As best seen in FIGS. 1–3, tappet body 6 is provided on its outer periphery with an axial guide groove 13 of semicircular cross-section, which preferably can be produced by milling or grinding. As shown in FIGS. 1, 4 and 5, the cylindrical tappet bore 4 is similarly provided with an axial guide groove 14 of semicircular cross-section (FIG. 5) that faces the groove 13. The groove 14 is formed by first boring a correspondingly small bore in the cylinder head or, alternatively, in the cylinder block 3, and then boring the large cylindrical tappet bore 4 in a manner overlapping or intersecting the small bore, which then opens part of the small bore longitudinally.

In the case where the roller tappet 5 is provided with a hydraulic lash adjuster device 8, as illustrated in FIG. 1, a lock pin type guide member 16, with a round cross-section, is inserted into and engages into both the axial guide groove 13 on the roller tappet 5 and into the axial guide groove 14 in the wall of tappet bore 4. It is secured to a closure plate or cover element 15 for the lash adjusting device 8.

In this connection, the closure or cover plate 15 is formed as a pressed sheet metal part from which the guide member 16 is formed by C-shaped bending over of a portion thereof. The top of member 16 then is bent 90° with respect to the neck portion of the closure element and the closure element 15 secured to the tappet body 6 within an annular groove 17.

In this connection, the flanging-over or bending-in of the closure plate, which is already necessary for securing the individual parts of the hydraulic lash adjusting device inside the roller tappet 5, will also secure the guide member to the tappet body, as a result of which no additional operating procedure is required for securing the lock pin 16 to the tappet body.

The guide member can also be secured to the tappet body by means of other known fastening methods, such as snapping in, clamping in, wedging, welding or the like. The guide member further could be completely independent of a closure member for the hydraulic lash adjusting device of the roller tappet.

From the foregoing, it will be clear that the insertion of the guide member 16 into the two facing semicylindrical bores 13 and 14 will lock the tappets to the cylinder head, and thereby prevent rotation of the tappet. It also will be seen that the axial grooves 13 and 14, and the guide member 16 can be produced in a simple yet effective manner, resulting in an economical non-rotating tappet assembly, and that the guide member 16 being integral with the closure plate for the lash adjuster automatically secures the guide member to the tappet body when the plate is assembled to cover the lash adjuster.

While the invention has been shown and described in its preferred embodiments, it will be clear to those skilled in the arts to which it pertains that many changes and modifications may be made thereto without departing from the scope of the invention.

I claim:

1. A method of forming a roller tappet arrangement with rotation prevention means for use with internal combustion engines having a tappet body axially slidably mounted for a guided movement in a bore in the engine cylinder block/head and a cover plate enclosing a portion of the tappet body for securing the internal parts therein, comprising the steps of forming an axially extending guide groove by initially boring an appropriate small longitudinally extending bore in the cylinger head/block, subsequently opening the bore by boring a larger diameter cylindrical tappet bore in a manner intersecting a portion of the small bore to form a semicircular small bore cross-section, and bending from the cover plate a guide member/locking pin having a round or partly round cross-section and thereafter slidably inserting the tappet body into the engine tappet bore for a simultaneous insertion of the guide member/locking pin into the small opened axially extending cylinder bore to lock the block/head and tappet against relative rotation.

2. A roller tappet arrangement according to claim 1, including the additional step of securing the plate and guide member to the tappet by flanging over in the manner of a crown cork or by bending into an annular groove.

3. A roller tappet arrangement with rotation prevention means for use in internal combustion engines, comprising a tappet body slidably guided in a bore in the cylinder block/head, the wall portion defining the tappet bore having an axially extending guide groove therein of essentially semi-circular crosssection, the tappet body having a matingly shaped axially extending groove therein facing the cylinder groove, an annular cover plate enclosing a portion of the tappet assembly and serving as a guide for insertion of the tappet body into the cylinder bore, and a guide member/lock pin integral with the cover member and extending outwardly thereof in a direction parallel to the axis of the tappet and having a round or partly round cross-section formed therefrom into a lock type pin by bending round for cooperation with and insertion into the axial guide groove concurrent with the insertion of the tappet body into the cylinder bore, and means to secure the cover member and giude member to the tappet assembly.

4. A roller arrangement according to claim 3, the cover plate being secured to the tappet body by flanging over a portion thereof, the tappet body having an annular groove, and means on the cover plate engagable in the annular groove.

* * * * *